US007757898B2

(12) United States Patent
Gilliard, II

(10) Patent No.: US 7,757,898 B2
(45) Date of Patent: Jul. 20, 2010

(54) PORTABLE DISPENSING SYSTEMS

(75) Inventor: Ralph J. Gilliard, II, Arvada, CO (US)

(73) Assignee: The X Group Inc., Denver, CO (US)

( * ) Notice: Subject to any disclaimer, the term of this patent is extended or adjusted under 35 U.S.C. 154(b) by 385 days.

(21) Appl. No.: 10/574,415

(22) PCT Filed: Oct. 4, 2004

(86) PCT No.: PCT/US2004/032677

§ 371 (c)(1),
(2), (4) Date: Aug. 6, 2008

(87) PCT Pub. No.: WO2005/032998

PCT Pub. Date: Apr. 14, 2005

(65) Prior Publication Data

US 2008/0283554 A1 Nov. 20, 2008

Related U.S. Application Data

(60) Provisional application No. 60/508,533, filed on Oct. 2, 2003.

(51) Int. Cl.
*B67D 7/84* (2010.01)

(52) U.S. Cl. ..... 222/162; 222/182; 222/183; 222/321.7; 222/321.8; 222/321.9

(58) Field of Classification Search ..... 222/162, 222/182, 1, 183, 320, 321.1, 340, 321.7, 222/517, 321.8, 518, 321.9, 378, 383.1, 385; 239/333

See application file for complete search history.

(56) References Cited

U.S. PATENT DOCUMENTS

| | | | | |
|---|---|---|---|---|
| 3,405,843 | A | 10/1968 | Watson | 222/95 |
| 5,487,489 | A | 1/1996 | Weiss et al. | 222/1 |
| 6,305,580 | B1 | 10/2001 | Chen | 222/162 |
| 6,338,422 | B1 | 1/2002 | DeJonge | 222/162 |
| 2002/0134798 | A1 | 9/2002 | Lamboux | 222/251 |

FOREIGN PATENT DOCUMENTS

| | | |
|---|---|---|
| EP | 0 557 714 | 9/1993 |
| WO | WO 89/05107 | 6/1989 |
| WO | WO 91/01255 | 2/1991 |

OTHER PUBLICATIONS

Supplementary European Search Report for Application No. EP 04 79 4141, dated Jul. 28, 2009, 3 pages.

*Primary Examiner*—Frederick C. Nicolas
(74) *Attorney, Agent, or Firm*—Fish & Richardson P.C.

(57) ABSTRACT

A disposable dispensing device for storing and dispensing fluids, such as liquids and gels is disclosed. The dispensing device is a scalable packaging solution including an outer protective housing or shell, optionally a fluid reservoir, and an orifice from which the materials are expelled. The dispensing device can also include a dispensing button that activates an internal pumping system via an actuator mechanism that translates a force in a first direction into a force in a second direction. The dispensing device is particularly useful for liquids such as fragrances or colognes, gels, purified water, dry powders, creams, and pharmaceutical products such as eye ear drops or sprays. The device by design has many uses, is highly portable, and can include an outer reusable and decorative case.

29 Claims, 12 Drawing Sheets

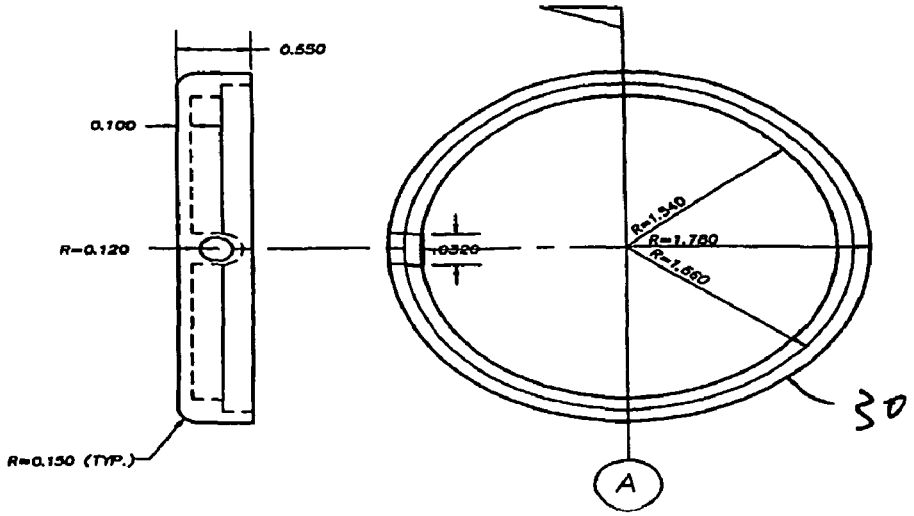
FIG. 1B
FIG. 1C
Front
Cross-section
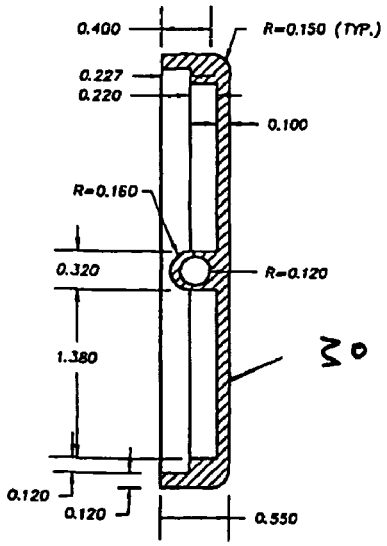
FIG. 1D

FIG. 2A
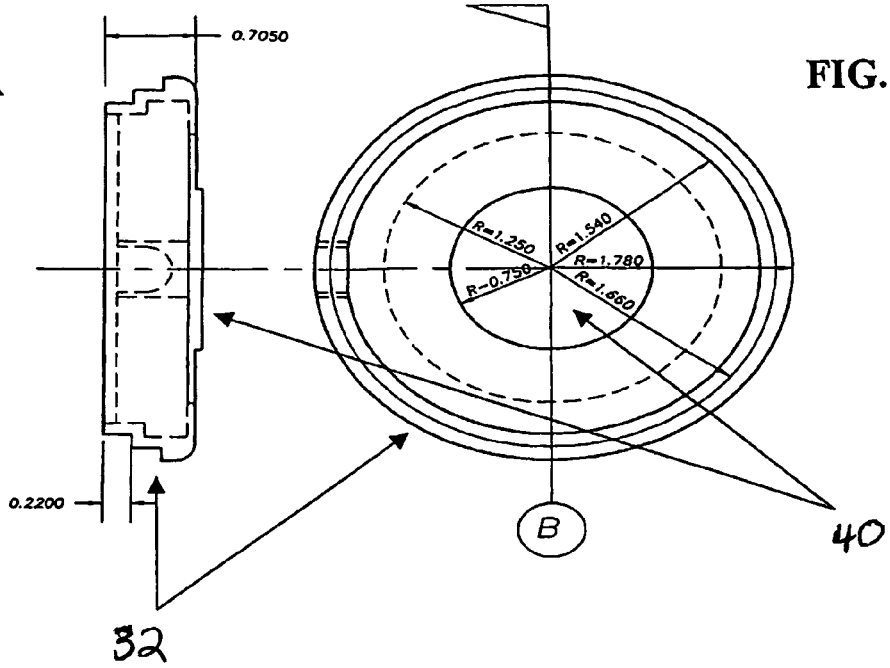
FIG. 2B
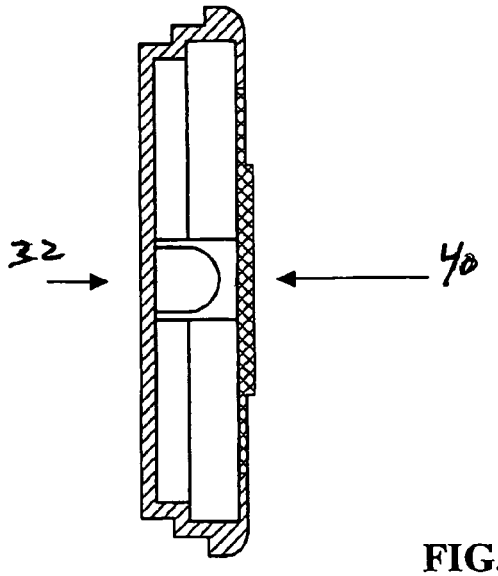
FIG. 2C

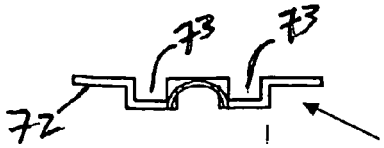
FIG. 5A
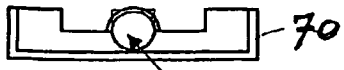
FIG. 5B
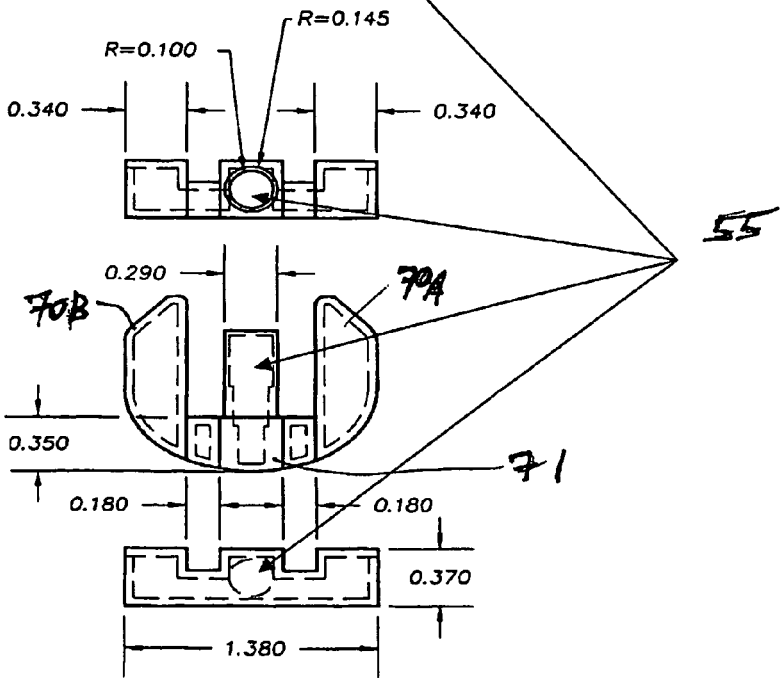
FIG. 5C
FIG. 5D
FIG. 5E

• Round Case •
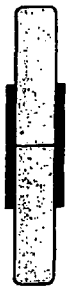
side viewv
FIG. 8A
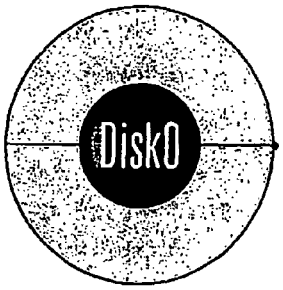
front view
FIG. 8B
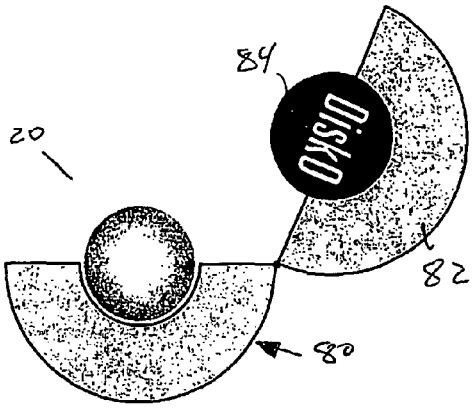
open case with disposable
FIG. 8C
• Rectangular Case •
FIG. 9A
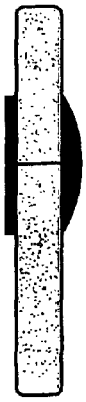
side view
FIG. 9B
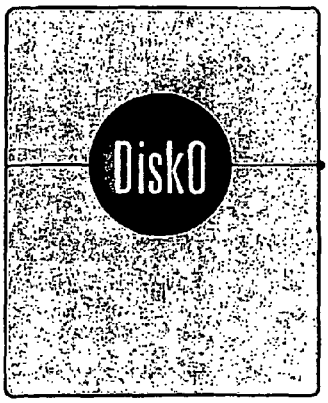
front view
FIG. 9C
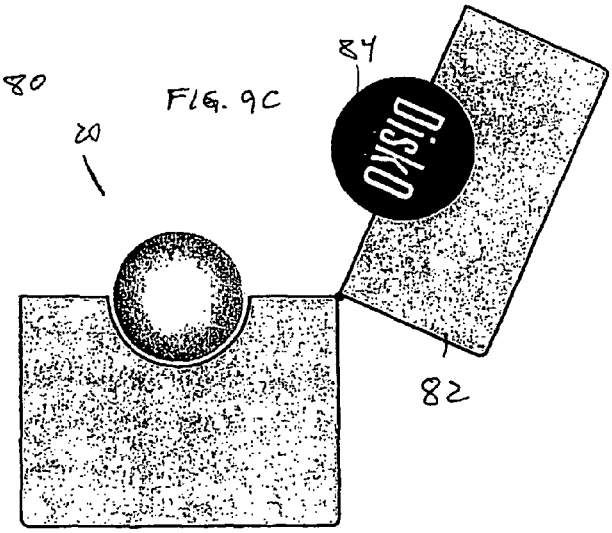
open case with disposable
• Square Case •
FIG. 10A
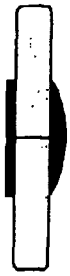
side view
FIG. 10B
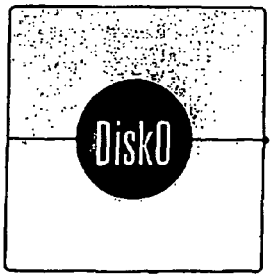
front view
FIG. 10C
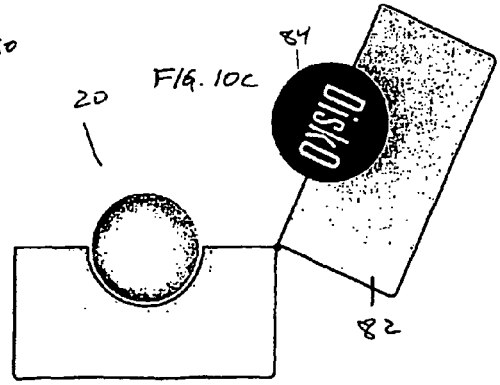
open case with disposable

PORTABLE DISPENSING SYSTEMS

CROSS-REFERENCE TO RELATED APPLICATION

This application claims priority under 35 U.S.C. §371 to international application number PCT/US2004/032677, filed on Oct. 4, 2004, which in turn claims priority to U.S. Provisional application No. 60/508,533, filed on Oct. 2, 2003. The subject matters of these applications are incorporated herein by reference in their entireties.

This applications claims the benefit of priority of U.S. Provisional Patent Application No. 60/508,533, filed on Oct. 2, 2003, the contents of which is incorporated herein by reference in its entirety.

TECHNICAL FIELD

This invention relates to self-contained, portable dispensing systems that can store and dispense fluids such as fragrances, colognes, gels, and creams.

BACKGROUND OF THE INVENTION

Many consumer products, such as those used for personal care and hygiene, come in the form of liquids, creams, or gels that are sprayed or otherwise applied to the skin, eyes, or mouth. Such products are typically stored in jars, tubes, or bottles that contain sufficient quantities of the product to provide multiple applications, but are not always convenient or safe for travel or for being carried in a purse or pocket.

SUMMARY OF THE INVENTION

The invention provides a unique packaging solution in the form of a highly functional and portable dispensing system for commercially available consumer products by way of metered dose(s). The range of products that the new systems can store and dispense is limited only by their size and internal pump design(s).

In general, the invention features fluid dispensing devices that include a hollow housing comprising one or more walls; an orifice arranged to pass through a wall of the housing; an optional reservoir that fits into the hollow interior of the housing; a pump that fits into the reservoir and includes a nozzle that contacts the orifice; and an actuating mechanism that contacts the pump; wherein a force applied to a portion of the actuating mechanism in a first direction causes the actuating mechanism to move the pump in a second direction, and causing it to expel fluid from the reservoir through the nozzle and out of the device through the orifice.

In these devices, the housing can include a lower shell and an upper shell connected to the lower shell to enclose a hollow interior. The devices can further include a dispensing button arranged in a wall of the housing to contact a portion of the actuating mechanism. In certain embodiments, the pump and the reservoir move together as one unit upon actuation.

In some embodiments, the actuating mechanism can include one or more front arms that contact the pump via a pressure plate secured to the pump, and one or more rear arms that rest against the housing. For example, the one or more rear arms can rest against a recess in, or protrusion extending from, a wall (e.g., bottom wall or floor) of the housing. In other embodiments, the actuating mechanism can include a body having a front portion and a rear portion connected by a hinge, wherein the front portion includes a first cutout and two front arms, one front arm being located on each side of the first cutout, configured to fit over the pump, and wherein the rear portion includes a second cutout and two rear arms, one rear arm being located on each side of the second cutout, configured to fit over the pump. The actuating mechanism can further include a tab attached to the rear portion that extends through a third cutout in the front portion when the actuating mechanism is bent at the hinge. The actuating mechanism can be made of plastic, and the hinge can be a living hinge.

In other embodiments, the actuating mechanism can include two elongated parts, each part having a front arm, a rear arm, and hinge connecting the two arms, and wherein the two elongated parts are arranged one on each side of the pump. For example, the two elongated parts can be attached to each other by a connecting bar, and the parts can be made of plastic, with the hinge being a living hinge.

In these devices, the reservoir can include two fluid chambers arranged one on each side of the pump chamber, and that are in fluid communication with each other and the pump chamber. The reservoir can include at least one fluid chamber and a pump chamber, and the pump fits into the pump chamber. The pump can include a body, a nozzle, and a spring within the body to press the nozzle out of the pump when pressed into the body by an external force, wherein the body, nozzle, and spring are aligned along one central axis. The devices can further include an orifice cup configured to fit into the orifice, for controlling the dispensing pattern of the fluid as it is expelled from the nozzle, e.g., as a spray, stream, mist, or drop of fluid.

In certain embodiments, the actuating mechanism includes one or more actuating arms having an angled face; and the device further includes a pump mount connected to the pump having a wedge surface that is arranged to contact the angled face of the actuating arm. In this arrangement, pressure on a portion of the actuating mechanism in a first direction causes the one or more actuating arms to move, causing the angled face to press against the wedge surface, causing the wedge surface and the pump to move in a second direction, and causing the pump to expel fluid from the reservoir through the nozzle and out of the device through the orifice.

In these devices, the first and second directions can be at approximately 80 to 100 degrees, e.g., approximately 90 degrees, to each other.

In another aspect, the invention also includes cases for the new fluid dispensing devices. These cases include a container configured to enclose the dispensing device, and a cover configured to allow the dispensing device to be inserted into and removed from the container. The covers of these cases can further include a portion that covers a dispensing button of the dispensing device. The cases can have a round, square, or rectangular profile, or have the shape of an animal, a flower, a heart, or a face.

In another aspect, the invention includes methods of dispensing a fluid by obtaining one of the new dispensing devices and applying a force to a portion of the actuating mechanism to expel one measured dose of fluid in the device. The device can be obtained pre-filled with a fluid, or the user can fill a desired fluid into the device. In these methods, applying a force to a portion of the actuating mechanism includes applying a downward force on a hinged actuation mechanism that converts the downward force into a force in a second direction within the dispensing device, and causes the pump to move and to expel fluid through the nozzle and out of the device through the orifice. The methods can be used to dispense perfume, water, mouthwash, deodorant, antiperspirant, cologne, pepper spray, or skin lotion.

The new dispensing systems are relatively inexpensive and disposable and can be used for many different products and for many different occasions, and are thus ideal for mass-market distribution. Metal versions of the same designs can be made to be more durable and non-disposable.

Other embodiments include ornamental and/or fashion accessories, e.g., cases, as well as external designs of the device and/or case that are in the shape of animals or other "fun" shapes. These devices can be filled with, e.g., "younger" scents and/or aroma type products that are designed to appeal to children or teenagers.

The new devices have clear advantages over similar size sampling type dispensers, offering their users the convenience of multiple uses in metered doses in the form of a spray, mist, stream, or drops. The device can be personally stored between uses. In addition, the new devices offer a scalable design that can be altered for both functional and ornamental presentation.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments of the invention are set forth in the accompanying drawings and the description below. Other features, objects, and advantages of the invention will be apparent from the description and drawings, and from the claims.

DESCRIPTION OF DRAWINGS

FIGS. 1B to 1D are side, top, and cross-sectional views, respectively, of the outer shell of the dispensing device of FIG. 1A.

FIGS. 2A to 2C are side, top, and cross-sectional views, respectively, of the outer shell lid and dispensing button.

FIGS. 4A to 4C are front, bottom, and side views, respectively, of a one-piece hinged actuating mechanism that fits over and is used to actuate the pump.

FIGS. 5A and 5B are front views of a reservoir cover and reservoir, respectively.

FIG. 5C is a front view of the reservoir and cover as assembled.

FIG. 5D is a top view of the reservoir.

FIG. 5E is a back view of the reservoir.

FIGS. 8A to 8C are side, top, and top with open case views, respectively, of a round case embodiment.

FIGS. 9A to 9C are side, top, and top with open case views, respectively, of a rectangular case embodiment.

FIGS. 10A to 10C are side, top, and top with open case views, respectively, of a square case embodiment.

Like reference numerals refer to like elements of the devices represented in these figures. Any dimensions shown in the figures are exemplary.

DETAILED DESCRIPTION

Figure 1A:
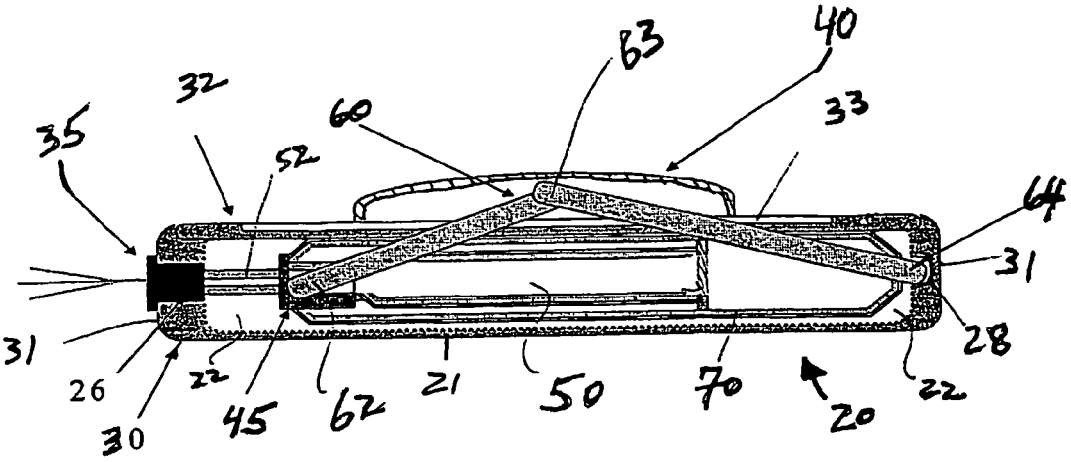
FIG. 1A is a cross-section of one embodiment of the new portable dispensing device.

FIG. 1A shows a side, cross-sectional view of dispensing device 20 having a housing 21 that in this embodiment includes a bottom shell 30, a top shell 32 that connects to, e.g., fits into, the bottom shell, e.g., with a press fit (and/or glue or other mechanism, e.g., a heat seal), and a dispensing button 40 situated in the top shell. Bottom shell 30 has a sidewall 31 that includes an opening 26 at one end and recesses 28 at an end opposite the opening 26. The bottom and top shells fit, e.g., snap, together to form the device 20 with a hollow interior 22. All other parts of the device fit within this hollow interior 22. Dispensing button 40 can also be hollow, and is arranged in top shell 32 so that it can be depressed into the device. Dispensing button 40 can be made of any elastic material, including rubber or neoprene, and can be fixed, e.g., glued, onto the top shell 32. The top and bottom shells can be made of any plastic, e.g., polyolefin or polystyrene, and can be made by various known methods, such as injection molding or machining solid plastic. Housing 21, e.g., shells 30 and 32, can also be made of metal, e.g., by stamping and/or machining.

In other embodiments, housing 21 includes separate sidewalls (e.g., a cylinder), a bottom, and a top, that fit together to form a sealed container, which houses the other parts of the system. The top can be flexible or compressible, so that it forms dispensing button 40 without the need for a separate button. Instead, the user merely presses on the flexible top to contact and apply force to the actuating mechanism 60, described in further detail below.

The contents of the dispensing device include a pump 50 including a nozzle 52 at one end (e.g., the "top"), and a pressure plate 45, which fits over and is secured to the top of pump 50. A reservoir 70 is also included within hollow interior 22 of device 20. Pump 50 includes an internal spring 51

Figure 14:
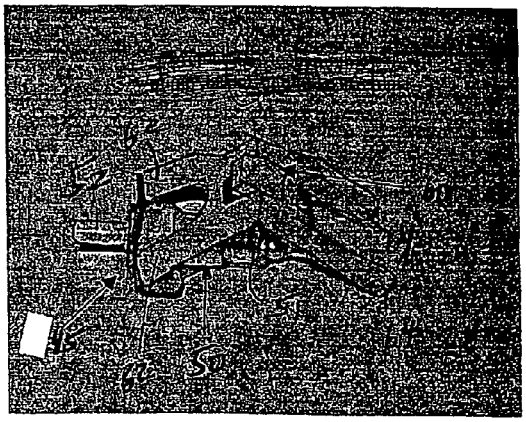
FIG. 14 is a side view of the actuating mechanism and pump minus reservoir and pump housing.

(as seen through the clear plastic of the pump in FIG. 14). An orifice cup 35 fits into opening 26 in sidewall 31 of the bottom shell 30, and has an opening at the bottom that fits snugly over nozzle 52 with a watertight seal (e.g., by glue or press fit). Orifice cup 35 controls the dispensing pattern of the dispensing device. The device can dispense the liquid as a fine mist, spray, stream, or droplets.

Interior space 22 also contains an actuating mechanism 60, e.g., a hinged actuating mechanism, which will be described in further detail below for various embodiments. FIGS. 1B-1C show side, top, and side cross-sectional views of the bottom shell 30. FIG. 1C shows the bottom shell having a round configuration, but various other shapes can be made. FIGS. 2A-2C show side, top, and side cross-sectional views of the top shell 32. FIG. 2C shows how dispensing button 40 extends slightly beyond the plane of the top shell. In other embodiments, the button can be flush with the surface, or slightly below the surface.

Figures 3A, 3B, 3C:
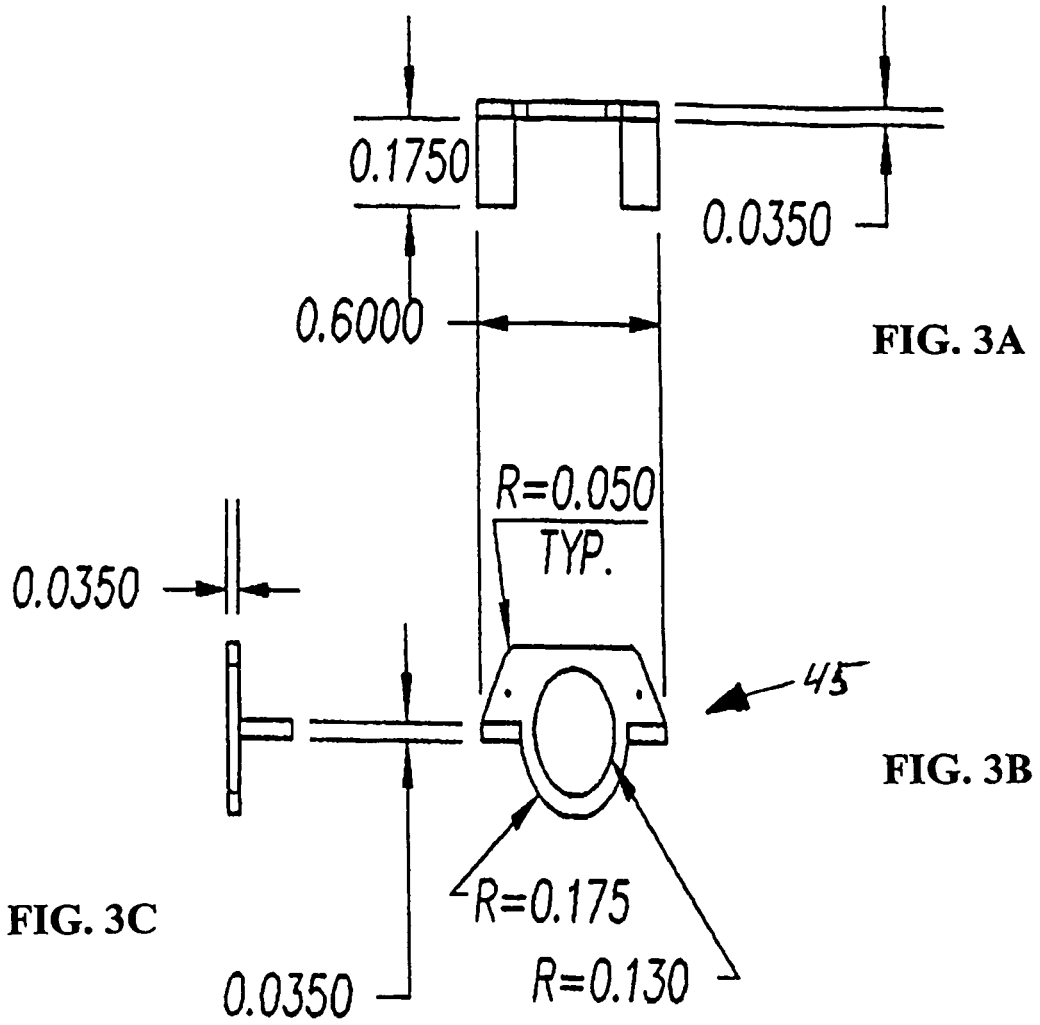
FIGS. 3A to 3C are front, top, and side views, respectively, of a pressure plate that fits over and contacts the end of a pump.

FIGS. 3A-3C show various views of pressure plate 45. This plate is designed to fit over the standard pump 50, and to provide a contact point for the front arms 62 of the hinged actuating mechanism 60. Pressure plate 45 can be made of metal, e.g., stainless steel or aluminum, and can be manufactured by stamping and bending metal sheeting. Pressure plate 45 can also be made from stiff plastic, e.g., by injection molding or milling.

FIGS. 4A-4C show various views of hinged actuating mechanism 60. Mechanism 60 includes an upward jutting tab 66 that rests against the underside of dispensing button 40. The mechanism also includes downward facing sidewalls 67 (that provide rigidity) and front and rear cutouts 68A and 68B that allow the mechanism to be bent at its hinge 63, and still fit over pump 50. In certain embodiments, actuating mechanism 60 is made of one part, e.g., of plastic, with a living hinge 63 in the middle, or can be made of two or more parts and connected, e.g., by glue or by melting the two parts together, to form hinge 63. Tab 66 fits within cutout 61.

Living hinges are thin sections of very flexible plastic, such as polyethylene or polypropylene, which connect two segments of a part to keep them together and allow the part to be bent repeatedly. These hinges must be processed properly. For example, the molecules of plastic in the hinge should be oriented along the hinge line for the hinge to have an acceptable life. For example, one can orient the gate location to allow the plastic to flow across the hinge for maximum strength. In addition, when the hinge is removed from a mold, it can be flexed a minimum of two times while it is still hot, for optimum strength.

The actuating mechanism 60 includes two front arms 62 and two rear arms 64 (as best seen in FIG. 4B). The front arms rest against pressure plate 45. Rear arms 64 of the hinged actuating mechanism can rest within recesses 28 in sidewall 31 of the bottom shell 30. In this embodiment, hinge 63 of the actuating mechanism 60 extends above the plane of the top shell 32 through an opening 33. Dispensing button 40 is located over, or covers, hinge 63. Actuating mechanism 60 can be made by injection molding or casting and/or machining. This part can also be made of metal. In other embodiments, all parts of actuating mechanism 60 are within, and do not extend beyond, housing 21.

Figure 4D:
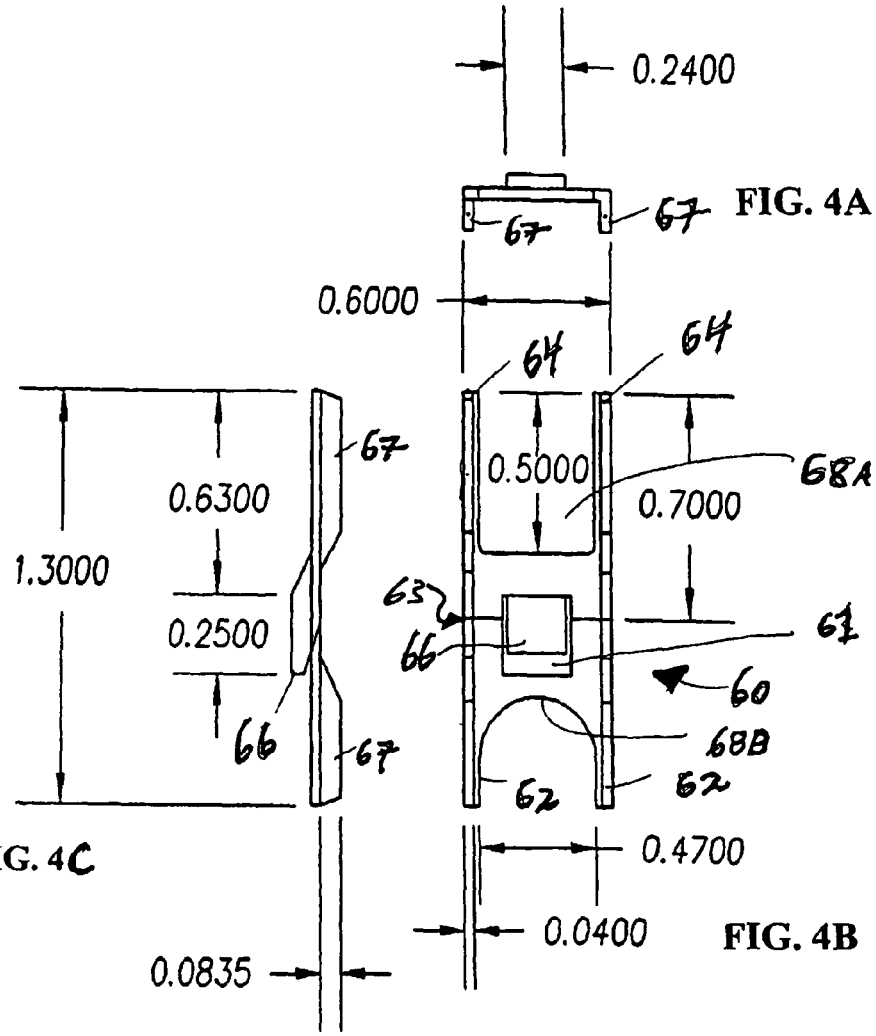
FIG. 4D is a schematic view of an alternative embodiment of a hinged actuating mechanism with two separate parts, optionally attached to each other by a connecting bar.
Figure 4D:
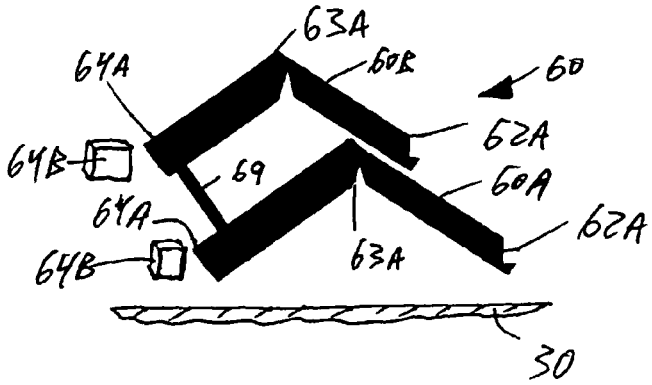

In alternative embodiments, actuating mechanism 60 can be formed of two separate elongated parts (60A and 60B), each with its own living hinge, e.g., as shown in FIG. 4D. In this embodiment, each of the two parts comprises a front arm 62A and a rear arm 64A connected by living hinge 63A. The two parts are inserted into housing 21 on either side of pump 50. The front arms 62A contact pressure plate 45 (e.g., with a cutout recess), and the rear arms 64A can contact recesses 28, much the same way as the front and rear arms of the one-piece design shown in FIGS. 4A-C. The two separate parts can be attached to each other with connecting bar 69. Alternatively, rear arms 64A can contact a ridge or protrusion 64B on the floor of bottom shell 30. This approach can also be used with the one-piece actuating mechanism described above.

In both embodiments, the actuating mechanism translates force applied to the dispensing button 40 in a first direction (e.g., a downward force) into a force on the pressure plate 45 in a second direction (e.g., a lateral force) to move the pump towards a sidewall of the housing 21 and dispense liquid from the nozzle 52 and orifice cup 35. The first direction can be about 70 to 110°, 75 to 105°, or 80 to 100°, e.g., about 90° (e.g., perpendicular), to the second direction.

FIGS. 5A to 5E show different views of a reservoir 70, which contains the liquid or gel consumer product, such as perfume, mouth wash, purified water, deodorant, antiperspirant, cologne, pepper spray, skin lotion, aroma therapy, or metered eye or nose sprays or drops. Reservoir 70 is made of hollow plastic or metal, has a cover 72, and includes a pump chamber 55, into which pump 50 is inserted, e.g., with a press fit, but that allows liquid from the other chambers of the reservoir to reach the back end of the pump. Reservoir 70 includes at least one, e.g., two, liquid chambers 70*a* and 70*b* (as best seen in FIG. 5D), and these are both in fluid communication with pump chamber 55, so that when pump 50 is inserted into pump chamber 55, and reservoir 70 is filled with a liquid, pump 50 is immersed in the liquid and can withdraw liquid from the reservoir though its back end 58. The back end of the two liquid chambers and the pump chamber 55 are in fluid communication via cross-chamber 71. Recesses 73 in the top of the reservoir provide space for the rear arms 64 of the actuating mechanism to contact recesses 28 in the lower shell 30. In certain embodiments, the housing (which can be made watertight) itself forms the reservoir, and no separate reservoir is included. Thus, the reservoir is optional.

Figure 5F:
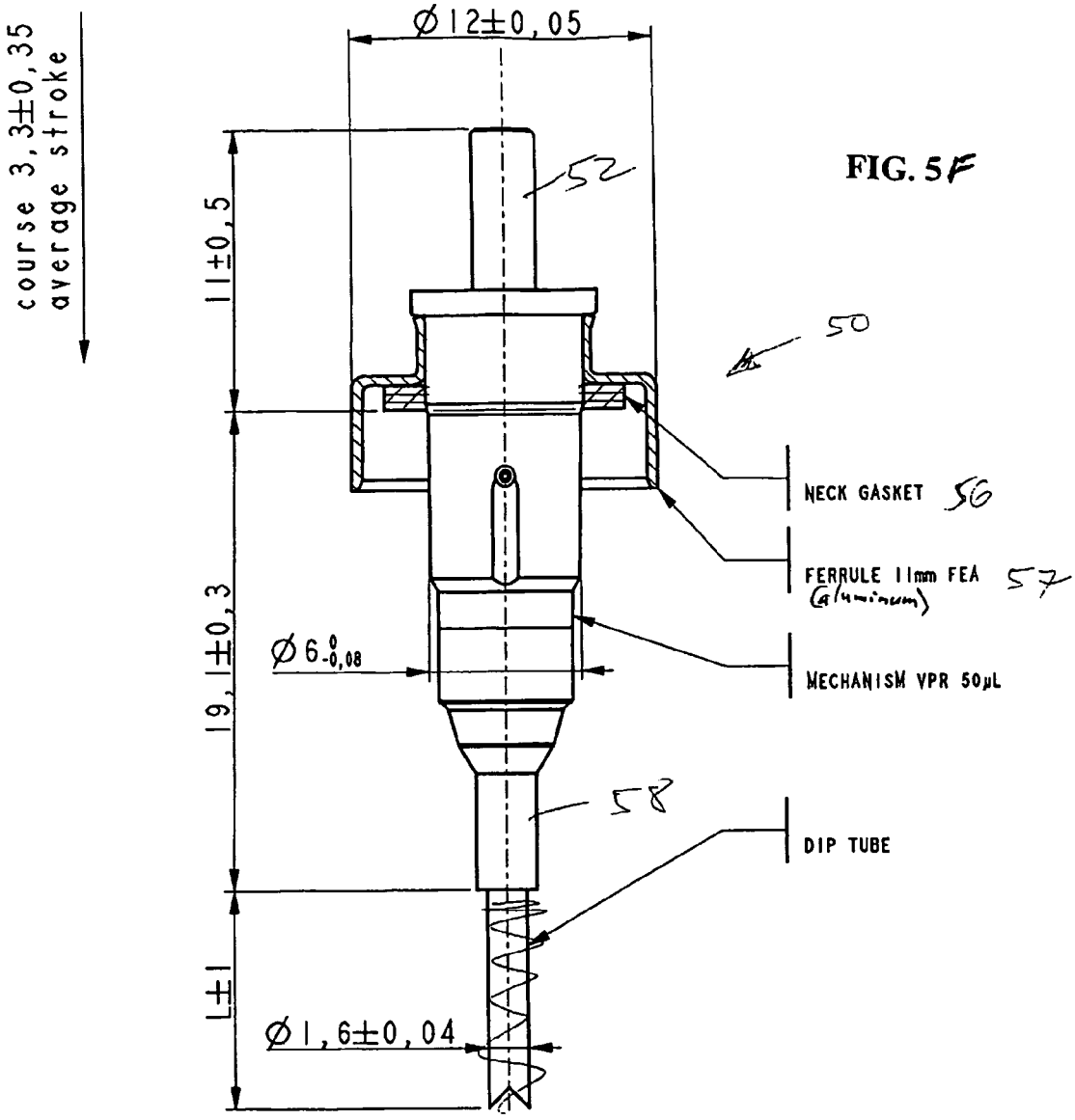
FIG. 5F is a side view of a suitable pump for use in the new dispensing devices.

Pump 50 is a stock item, e.g., it can be a so-called "Replica™" pump made by Valois America. Other pumps of the appropriate size and configuration can be used. For example, the Replica pump is shown in FIG. 5F. The neck gasket 56 and ferrule 57 of the pump are connected to pressure plate 45 and reservoir 70. Pressure plate 45 has a hole and fits over the pump 50 from the rear and is stopped at the top of pump 50 by neck gasket 56. Pump 50 and pressure plate 45 are then inserted into reservoir 70, which secures the pressure plate 45, e.g., by being "sandwiched." Pump 50 dispenses liquids and gels from nozzle 52, and liquids and gels enter into back end 58. The main aspects of the pump are that it has a nozzle that extends into the orifice cup or out of the housing, and has an internal spring that allows the nozzle to be pressed into the pump and then be forced out of the pump by the spring. Pump 50 is pressure fitted into, glued, or otherwise connected to the hole at the front of reservoir 70 to form a liquid-tight seal.

The reservoir can be filled in the factory before the cover is secured to the reservoir (e.g., for disposable embodiments). Reusable embodiments of the device can include an access port and stopper, e.g., a threaded or press fit stopper (not shown) in the reservoir to enable consumers to fill various liquid or gel products into the reservoir.

Figure 6A:
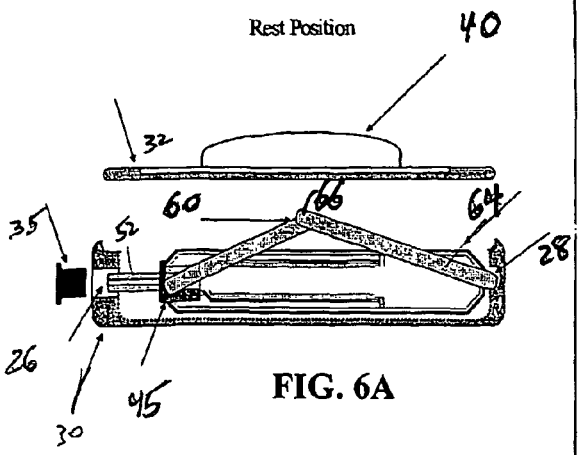
FIG. 6A is a side, cross-sectional view of a dispensing device in its resting position.
Figure 7A:
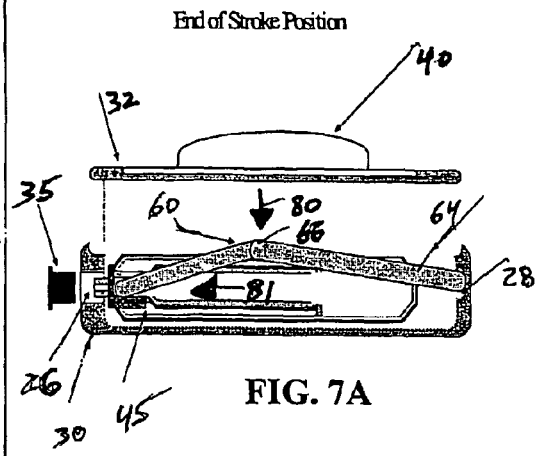
FIG. 7A is a side, cross-sectional view of the dispensing device at its end of stroke position.
Figure 6B:
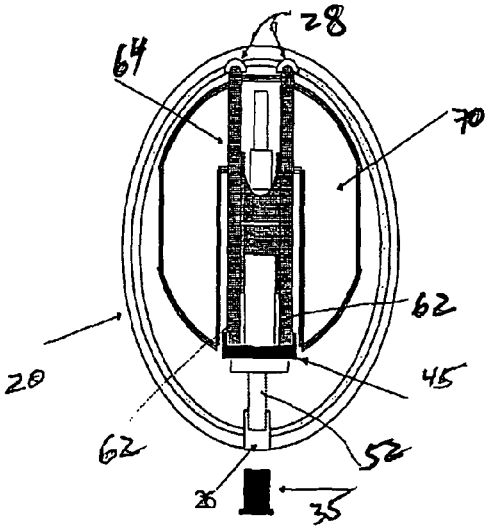
FIG. 6B is a top, cut-away view of the dispensing device in its resting position.
Figure 7B:
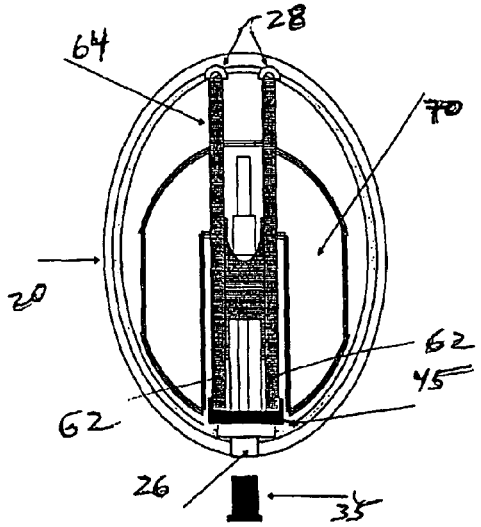
FIG. 7B is a top, cut-away view of the dispensing device at its end of stroke position.

From its resting position as illustrated in (FIGS. 6A and 6B) device 20 is operated by pointing the orifice cup 35 in the direction one wishes to manually release its contents, and pressing outer dispensing button 40, mounted in the top shell 32 (or in some embodiments, by merely pressing on the top shell if it is flexible). This action starts the actuating process by means of pressure, e.g., downward pressure (arrow 80), applied to tab 66 of hinged actuating mechanism 60 (or directly on living hinge 63). The hinged actuating mechanism 60 moves in a downward motion causing it to flatten lengthwise and move pressure plate 45 towards the orifice cup 35 in the direction of arrow 81. Rear arms 64 of hinged actuating mechanism 60 are securely seated in recesses 28 in the lower shell 30 (or contact projections 64A in the floor of the housing), and thus cannot move laterally within the lower shell 30. Front arms 62 are seated on the pressure plate 45, which is fitted over horizontally mounted pump 50, and when button 40 (or top shell 32) is pressed downwards, these arms are the only part of the actuating mechanism that can move laterally within the bottom shell 30. As a result, pressure plate 45 moves laterally, and pulls the entire pump 50 and reservoir 70 with it, towards orifice cup 35 as shown in FIGS. 7A and 7B.

This lateral movement causes the nozzle 52 to be pressed into pump 50, causing it to expel one measured dose of the contents of reservoir 70 in a predetermine discharge pattern, e.g., a spring, stream, and drop, depending on the liquid and dosage or amount to be dispensed. By releasing dispensing button 40, spring 51 inside pump 50 causes nozzle 52 to be pressed out of the pump, thereby moving pressure plate 45 laterally away from the orifice cup, and moving the pump and the reservoir away from the orifice cup as well. As a result, hinged actuating mechanism 60 is bent upwards, in preparation for the next actuation. Mounting the dispensing button 40 flush into the top shell 32 provides an accidental discharge safety feature.

The new dispensing devices offer high consumer portability and same package multi-application(s), with an ornamental design that can be cosmetically altered by way of production materials or methods and/or after market accessories. Thus, the housing 21 of the devices themselves can be circular, elliptical, rectangular, triangular, or other shapes. In addition, as shown in FIGS. 8A-C, sturdy plastic or metal cases 80 can be manufactured to allow the new dispensing devices 20 to fit inside. Each case 80 includes a cover 82 that includes a portion 84 that covers dispensing button 40, and can be provided with a company name, advertising slogan, or other insignia, e.g., by engraving or laser or other printing techniques. Dispensing devices 20 can be disposable or refillable, and case 80 can be reused over and over by inserting a new device 20. Case 80 can be made of machined or stamped and bent metal, such as aluminum. Alternatively, case 80 can be made of clear or colored plastic using standard techniques.

Figure 11:
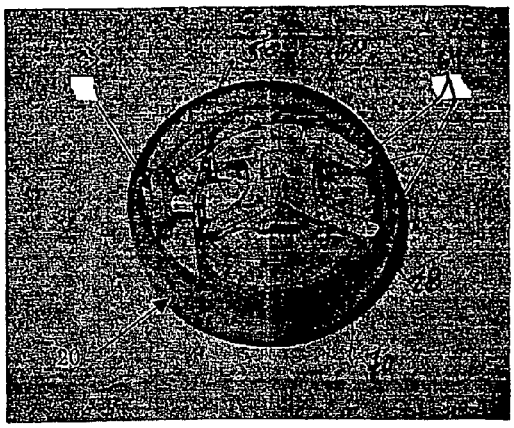
FIG. 11 is a three-quarter view of the dispensing device minus the outer lid (cover or top "shell") and dispensing button.

FIG. 11 shows a view of a prototype of dispensing device 20 with top shell 32 and dispensing button 40 removed. Orifice cup 35 is inserted into opening 26 and rear arms 64 of actuating mechanism 60 are inserted into recesses 28. Pump 50 is seen below actuating mechanism 60.

Figure 12:
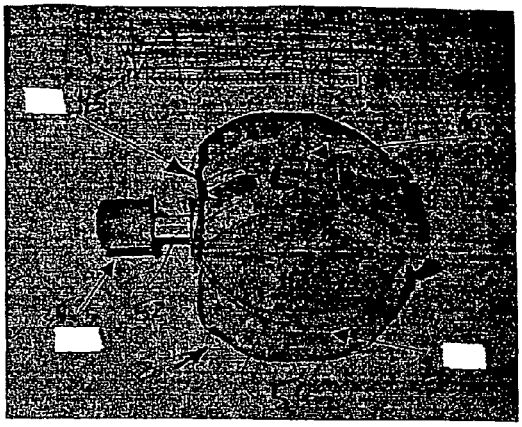
FIG. 12 is a three-quarter view of the actuating assembly with mounted pump.
Figure 13:
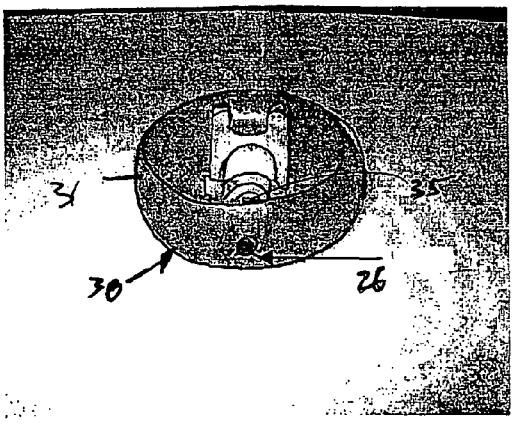
FIG. 13 is a top-front view of the dispensing device without the cover (top "shell") showing the orifice cup.

FIG. 12 shows a view of the "insides" of dispensing device 20, including reservoir 70, pump 50 with nozzle 52 connected to orifice cup 35, pressure plate 45, and actuating mechanism 60. FIG. 13 shows a front view of device 20 showing orifice cup 35 inserted in opening 26 in sidewall 31 of bottom shell 30.

FIG. 14 shows actuating mechanism 60 connected to pressure plate 45 by its front arms 62, which, in turn, is connected to pump 50 (including spring 51).

Figure 15B:
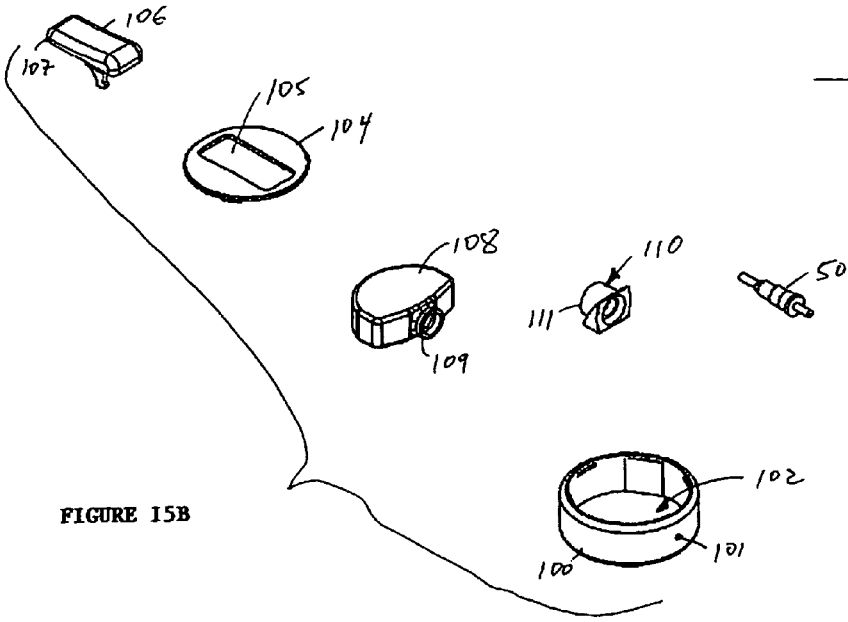
FIG. 15B is an "exploded" view of the embodiment of FIG. 15A.
Figure 15A:
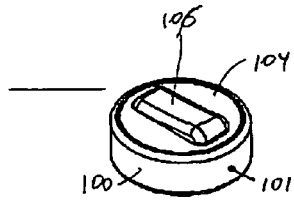
FIG. 15A is a three-quarter view of an alternative embodiment of a portable dispensing device.

FIG. 15A shows an alternative embodiment of the portable dispensing device. FIG. 15B shows an "exploded" view of this device. This second embodiment of the device includes a housing 100 with a base 102, and a lid 104. Dispensing button 106 is inserted into housing 100 and protrudes through lid 104. Button 106 has a flange 107 that prevents it from being pulled out of the device through opening 105 in lid 104.

Reservoir 108 fits inside housing 100 and is connected, e.g., by a pressure fit, to pump mount 110. Pump 50 fits securely in pump mount 110, and is inserted into reservoir 108. Reservoir neck 109 is press fit or threaded into opening 111 in pump mount 110, thereby sealing pump 50 inside reservoir 108.

Figure 16:
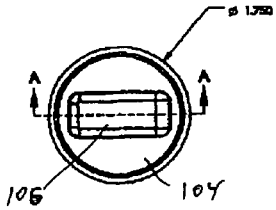
FIG. 16 is a top view of the assembled device of FIG. 15A.
Figure 17:
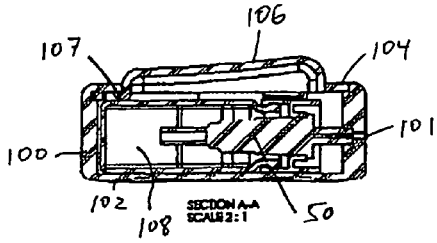
FIG. 17 is a side cross-sectional view of the device of FIG. 15A.

FIG. 16 shows a top view of this device. FIG. 17 is a side cross-sectional view of the device along section line A-A in FIG. 16. When pump 50 is moved forwards (to the right in FIG. 17), nozzle 52 is pressed into the pump, thereby drawing liquid from reservoir 108 and expelling it through orifice 101 in housing 100. In this embodiment, there is no need for an orifice cup, but one can be used.

Figure 18A:
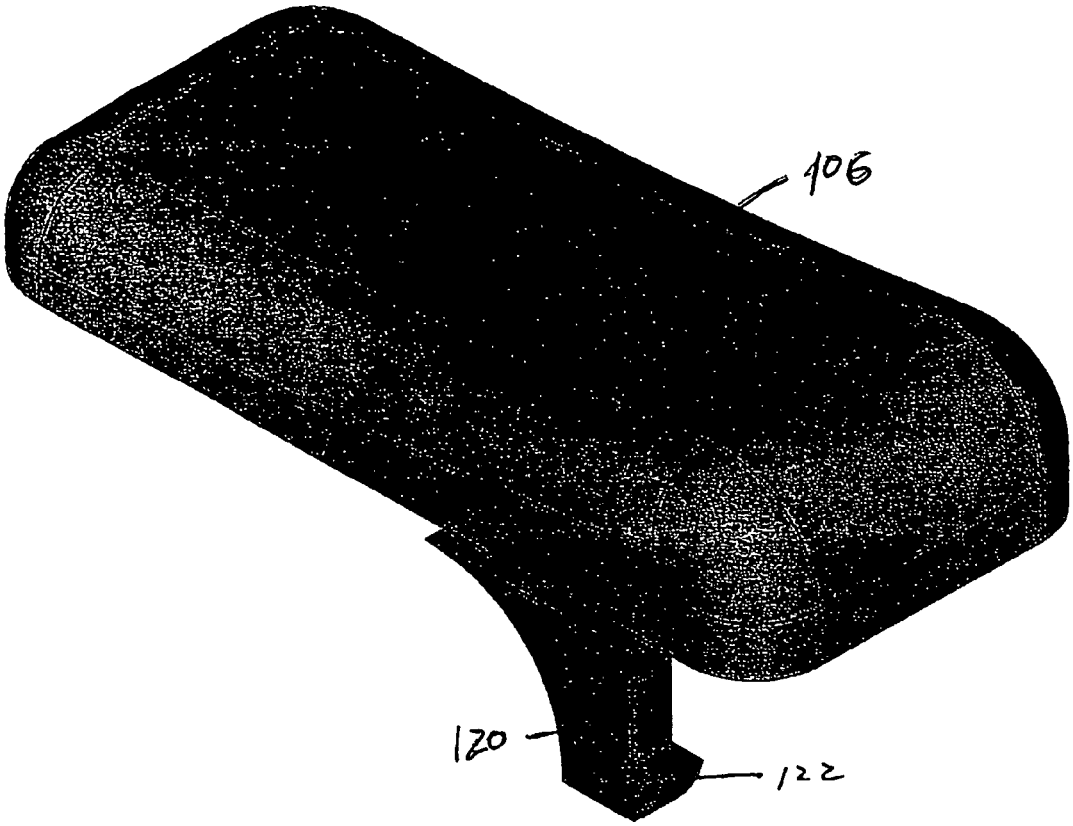
FIG. 18A is three-quarter view of a dispensing actuator button of the device of FIG. 15A.
Figure 18B:
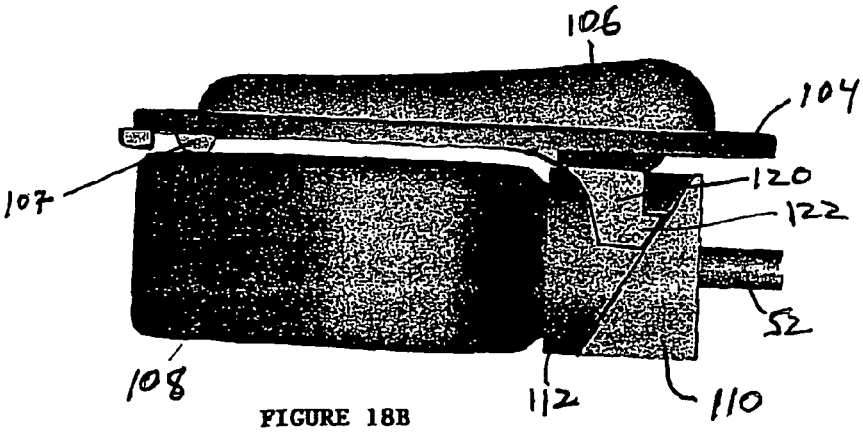
FIG. 18B is a side view of the dispensing actuator button as inserted in the device of FIG. 15A.

FIG. 18A shows dispensing button 106 and its actuating arms 120 (the second arm is not visible in this figure). The two actuating arms straddle pump mount 110 (which is similar to pressure plate 45). As best seen in FIG. 18B, each actuating arm 120 has an angled face 122 that contacts a wedge 112 on either side of pump mount 110.

When dispensing button 106 is pushed downward, the two angled faces 122 are pressed against the two wedges 112 on either side of pump mount 110. This pressure, in turn, forces the wedges, and thus the pump mount, pump, and reservoir, to move horizontally (laterally) forwards (right in FIG. 18B). This causes nozzle 52 of pump 50 to be pressed into the pump causing it to expel liquid drawn from reservoir 108. In other respects, this device is similar to the first embodiment described herein.

Thus, in all embodiments, a force in a first direction (e.g., downwards) is applied to a surface of the device, or a dispensing button, which contacts an actuator mechanism that translates the force into a second direction (e.g., horizontally or laterally), which is approximately (or exactly) at 90° to the first direction. The force in the second direction moves an internal pump towards a wall of the device, causing a nozzle of the pump to be pushed into the pump to dispense liquid contained in the housing or reservoir in the housing.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A fluid dispensing device comprising a hollow housing comprising one or more walls;

an orifice arranged to pass through a wall of the housing;

a reservoir that fits into the hollow interior of the housing;

a pump that fits into the reservoir and includes a nozzle that contacts the orifice; and an actuating mechanism that contacts the pump;

wherein a force applied to a portion of the actuating mechanism in a first direction causes the actuating mechanism to move the pump in a second direction, and causing it to expel fluid from the reservoir through the nozzle and out of the device through the orifice, wherein the actuating mechanism comprises:

one or more front arms that contact the pump; and one or more rear arms that extend from the one or more front arms to a recess in, or a protrusion extending from, a wall of the housing.

2. The device of claim 1, wherein the housing comprises a lower shell and an upper shell connected to the lower shell to enclose a hollow interior.

3. The device of claim 1, further comprising a dispensing button arranged in a wall of the housing to contact a portion of the actuating mechanism.

4. The device of claim 1, wherein the one or more front arms contact the pump via a pressure plate secured to the pump.

5. The device of claim 1, wherein the protrusion extends from a bottom wall of the housing.

6. The device of claim 1, wherein the pump and the reservoir move together as one unit.

7. The device of claim 1, wherein the actuating mechanism comprises a body having a front portion and a rear portion connected by a hinge, wherein the front portion comprises a first cutout and two front arms, one front arm being located on each side of the first cutout, configured to fit over the pump, and wherein the rear portion comprises a second cutout and two rear arms, one rear arm being located on each side of the second cutout, configured to fit over the pump.

8. The device of claim 7, wherein the actuating mechanism further comprises a tab attached to the rear portion that extends through a third cutout in the front portion when the actuating mechanism is bent at the hinge.

9. The device of claim 7, wherein the actuating mechanism is made of plastic, and the hinge is a living hinge.

10. The device of claim 1, wherein the actuating mechanism comprises two elongated parts, each part comprising a front arm, a rear arm, and hinge connecting the two arms, and wherein the two elongated parts are arranged one on each side of the pump.

11. The device of claim 10, wherein the two elongated parts are attached to each other by a connecting bar.

12. The device of claim 10, wherein the parts are made of plastic, and the hinge is a living hinge.

13. The device of claim 1, wherein the reservoir comprises two fluid chambers arranged one on each side of the pump chamber, and being in fluid communication with each other and the pump chamber.

14. The device of claim 1, wherein the pump comprises a body, a nozzle, and a spring within the body to press the nozzle out of the pump when pressed into the body by an external force, wherein the body, nozzle, and spring are aligned along one central axis.

15. The device of claim 1, further comprising an orifice cup configured to fit into the orifice, for controlling the dispensing pattern of the fluid as it is expelled from the nozzle.

16. The device of claim 15, wherein the dispensing pattern is a spray, stream, or drop of fluid.

17. The device of claim 1, wherein the reservoir comprises at least one fluid chamber and a pump chamber, and the pump fits into the pump chamber.

18. The fluid dispensing device of claim 1, wherein the actuating mechanism comprises one or more actuating arms having an angled face; the device further comprises a pump mount connected to the pump and having a wedge surface that is arranged to contact the angled face of the actuating arm; and wherein pressure on a portion of the actuating mechanism in a first direction causes the one or more actuating arms to move, causing the angled face to press against the wedge surface, causing the wedge surface and the pump to move in a second direction, and causing the pump to expel fluid from the reservoir through the nozzle and out of the device through the orifice.

19. The device of claim 1, wherein the first and second directions are at approximately 80 to 100 degrees to each other.

20. The device of claim 1, wherein the first and second directions are at approximately 90 degrees to each other.

21. A case for a fluid dispensing device of claim 1, comprising a container configured to enclose the dispensing device, and a cover configured to allow the dispensing device to be inserted into and removed from the container.

22. The case of claim 21, wherein the cover further comprises a portion that covers a dispensing button of the dispensing device.

23. The case of claim 21, wherein the case has a round, square, or rectangular profile.

24. The case of claim 21, wherein the case has the shape of an animal, a flower, a heart, or a face.

25. A method of dispensing a fluid, the method comprising obtaining a device of claim 1; and applying a force to a portion of the actuating mechanism to expel one measured dose of fluid in the device.

26. The method of claim 25, wherein applying a force to a portion of the actuating mechanism comprises applying a downward force on a hinged actuation mechanism that converts the downward force into a force in a second direction within the dispensing device, and causes the pump to move and to expel fluid through the nozzle and out of the device through the orifice.

27. The method of claim 25, wherein the first and second directions are at approximately 80 to 100 degrees to each other.

28. The method of claim 25, wherein the first and second directions are at approximately 90 degrees to each other.

29. The method of claim 25, wherein the fluid is perfume, water, mouthwash, deodorant, antiperspirant, cologne, pepper spray, or skin lotion.

* * * * *